US009879695B2

(12) United States Patent
Stahle et al.

(10) Patent No.: US 9,879,695 B2
(45) Date of Patent: Jan. 30, 2018

(54) SELF-CLEANING COVER PLATE IN A PUMP WITH RADIAL FLOW

(75) Inventors: Carl Stahle, Neunkirch (CH); Ciro Robles, Neunkirch (CH)

(73) Assignee: Frideco AG, Neunkirch (CH)

( * ) Notice: Subject to any disclaimer, the term of this patent is extended or adjusted under 35 U.S.C. 154(b) by 878 days.

(21) Appl. No.: 13/989,083

(22) PCT Filed: Nov. 24, 2011

(86) PCT No.: PCT/EP2011/070996
§ 371 (c)(1),
(2), (4) Date: May 23, 2013

(87) PCT Pub. No.: WO2012/069619
PCT Pub. Date: May 31, 2012

(65) Prior Publication Data

US 2013/0243568 A1 Sep. 19, 2013

(30) Foreign Application Priority Data

Nov. 24, 2010 (EP) ..... 10192467

(51) Int. Cl.
*F04D 29/40* (2006.01)
*F04D 7/04* (2006.01)
(Continued)

(52) U.S. Cl.
CPC ..... *F04D 29/40* (2013.01); *F04C 2/16* (2013.01); *F04D 7/04* (2013.01); *F04D 29/445* (2013.01);
(Continued)

(58) Field of Classification Search
CPC .... F04D 29/701; F04D 29/086; F04D 29/106; F04D 29/126; F04D 29/42; F04D 29/426;
(Continued)

(56) References Cited

U.S. PATENT DOCUMENTS 2,769,390 A 11/1956 Heimbuch
3,115,841 A 12/1963 Tilson
(Continued)

FOREIGN PATENT DOCUMENTS

CH 396639 A 7/1965
CN 101294580 A 10/2008
(Continued)

OTHER PUBLICATIONS

Office Action issued by the Chinese Patent Office dated Mar. 31, 2015 in corresponding Chinese patent application No. 201180056681.8 (and English translation).
(Continued)

*Primary Examiner* — Gregory Anderson
*Assistant Examiner* — Julian Getachew
(74) *Attorney, Agent, or Firm* — Posz Law Group, PLC

(57) ABSTRACT

The invention relates to a cover plate (2) for a screw-type centrifugal wheel pump (1), wherein the cover plate (2) has a front side (2*h*) and a rear side (2*i*), and wherein the front side (2*h*) comprises a surface part (2*k*) which runs in a preferably frustoconical manner and the profile of which is designed to be matched to the rear side of a screw-type centrifugal wheel (25), wherein the surface part (2*k*) has, in the center thereof, a central opening (2*g*), wherein the central opening (2*g*) runs in the direction of an axis (A), and wherein the cover plate (2) has at least one aperture (2*a*) which is arranged in the region of the surface part (2*k*) and spaced apart from the central opening (2*g*), and wherein the aperture (2*a*) forms a fluid-conducting connection between the front side (2*h*) and the rear side (2*i*) of the cover plate (2).

16 Claims, 5 Drawing Sheets

(51) Int. Cl.
*F04D 29/44* (2006.01)
*F04D 29/70* (2006.01)
*F04C 2/16* (2006.01)

(52) U.S. Cl.
CPC ..... *F04D 29/708* (2013.01); *F05D 2250/15* (2013.01)

(58) Field of Classification Search
CPC ..... F04D 29/445; F04D 29/22; F04D 29/708; F04D 7/02; F04D 7/04; F04D 7/045
USPC ..... 416/181, 183, 185
See application file for complete search history.

(56) References Cited

U.S. PATENT DOCUMENTS 3,632,220 A 1/1972 Lansinger
4,773,823 A * 9/1988 Pease ..... F04D 29/128 415/176
4,812,108 A * 3/1989 Kotera ..... F04D 29/0413 415/111
4,921,400 A * 5/1990 Niskanen ..... F04D 29/708 415/169.1
5,156,522 A * 10/1992 Tessier ..... F04D 29/167 415/170.1
5,195,867 A * 3/1993 Stirling ..... F04D 29/061 415/111
6,190,121 B1 * 2/2001 Hayward ..... F04D 7/045 415/121.1
7,008,177 B2 * 3/2006 Britt ..... F04D 29/128 415/111

FOREIGN PATENT DOCUMENTS

CN 101294580 B 4/2010
EP 1041320 A2 10/2000
EP 10192467 11/2011
EP 2011070996 11/2011
GB 1125376 A 8/1968
JP 2013-540376 3/2015
WO 8606799 A1 11/1986

OTHER PUBLICATIONS

Office Action dated Jun. 15, 2015 in the corresponding Chinese patent application No. 201180056678.6 (English translation attached).
Japanese Office Action dated Dec. 8, 2015 in the corresponding JP application No. 2013-540376. ( English translation attached.).
Office Action dated Feb. 22, 2016 issued in corresponding CN patent application No. 201180056678.6 (and English letter regarding concise explanation of relevance of Office Action from CN associate).

* cited by examiner

Prior Art

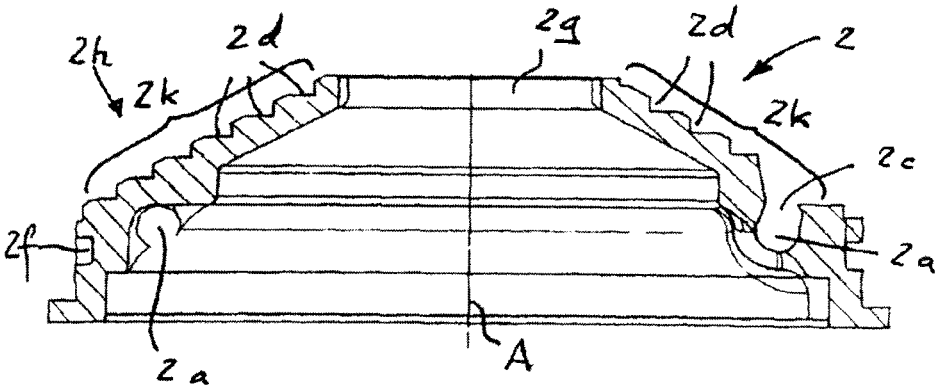
Figure 8 (B - B)
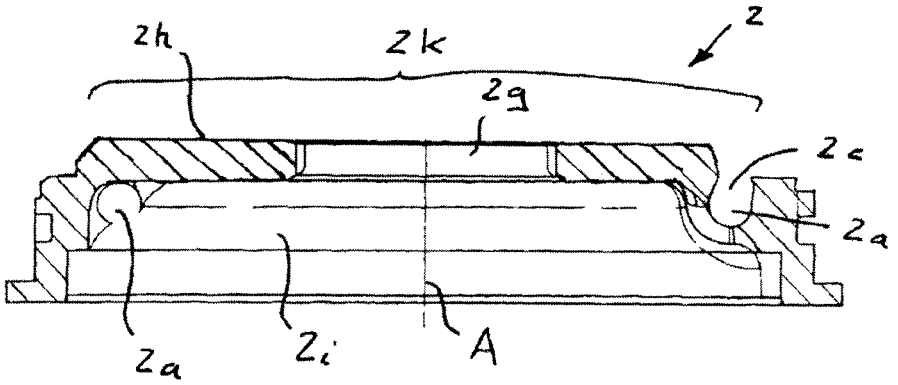
Figure 9
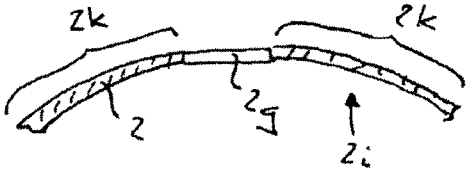
Figure 10
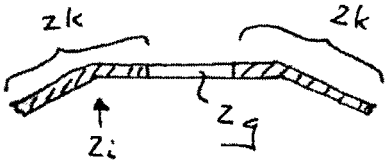
Figure 11

SELF-CLEANING COVER PLATE IN A PUMP WITH RADIAL FLOW

RELATED APPLICATIONS

This Application is a National Phase Application of, and claims priority to, PCT Application No. PCT/EP2011/070996, the disclosure of which is incorporated herein by reference.

The invention relates to a cover plate for a screw-type centrifugal wheel pump, to a screw-type centrifugal wheel pump comprising a cover plate of this type, and to a method for cleaning a screw-type centrifugal wheel pump comprising a cover plate of this type.

PRIOR ART

Document CH 662 864 discloses a screw-type centrifugal wheel pump, the screw-type centrifugal wheel being mounted rotatably on a rotational pin. The screw-type centrifugal wheel pump has a cavity in the region of the connection between the screw-type centrifugal wheel and the rotational pin. This embodiment, which is very established per se, of a screw-type centrifugal wheel pump has the disadvantage that contaminants can be deposited and can accumulate within the cavity. This results in an increased wear and/or an increased outlay on maintenance.

SUMMARY OF THE INVENTION

It is an object of the present invention to configure a screw-type centrifugal wheel pump and to propose a method for cleaning a screw-type centrifugal wheel pump, which have more advantageous properties with regard to the accumulation of contaminants.

This object is achieved by way of a cover plate for a screw-type centrifugal wheel pump having the features of claim 1. Subclaims 2 to 9 relate to further, advantageous embodiments. Furthermore, the object is achieved by way of a screw-type centrifugal wheel pump having the features of claim 10. Claims 11 and 12 relate to further, advantageous embodiments.

Furthermore, the object is achieved by way of a method for self-cleaning of a screw-type centrifugal wheel pump having the features of claim 13. Claim 14 relates to a further, advantageous method step.

The object is achieved, in particular, by way of a cover plate for a screw-type centrifugal wheel pump, the cover plate having a front side and a rear side, and the front side comprising a preferably frustoconically extending part surface, the form of which is configured so as to be adapted to the rear side of a screw-type centrifugal wheel, the part surface having a central opening in its center, the central opening extending in the direction of an axis, and the cover plate having at least one aperture which is arranged in the region of the part surface and spaced apart from the central opening, and the aperture forming a fluid-conducting connection between the front side and the rear side of the cover plate.

A screw-type centrifugal wheel pump having the cover plate according to the invention has the advantage that, during the pump operation, a part flow is formed which flows from the front side to the rear side of the cover plate and subsequently flows again to the front side of the cover plate along a central opening of the cover plate, with the result that a cleaning flow is formed which is capable of conveying any contaminants which are situated or accumulated in the cavity behind the cover plate at least partially to the front side of the cover plate again, with the result that said contaminants can be conveyed away via the main flow of the screw-type centrifugal wheel pump.

The screw-type centrifugal wheel pump according to the invention comprises a rotatably mounted screw-type centrifugal wheel and a cover plate which is arranged immediately next to the screw-type centrifugal wheel and has a central opening, a hub or a drive shaft of the screw-type centrifugal wheel preferably extending through the central opening. A fluid-conducting gap is formed between the central opening and the hub or the drive shaft. The rotating of the screw-type centrifugal wheel in the rotational direction causes a fluid to be conveyed along a main flow, which results in a part flow of the fluid flowing to the rear side of the cover plate via an aperture which is spaced apart with regard to the central opening, and in said part flow subsequently flowing back to the main flow via the fluid-conducting gap, on account of the pressure difference which prevails between the aperture and the fluid-conducting gap. Said part flow forms a cleaning fluid flow which, in particular, flows through the rear-side space of the cover plate and feeds any contaminants which are present to the main flow.

On the side which faces the screw-type centrifugal wheel or the part face which faces the screw-type centrifugal wheel, the cover plate preferably runs in accordance with the form of the rear side of the screw-type centrifugal wheel, with the result that the part face preferably runs frustoconically or flatly; the part face could also have a different profile shape, for example a curved or polyhedral form.

In the following text, the invention will be described in detail using exemplary embodiments.

BRIEF DESCRIPTION OF THE DRAWINGS

In the drawings which are used to explain the exemplary embodiments:

FIG. 8 shows a section through the cover disk according to FIG. 6 along the line A-A, FIG. 9 shows a section through a further exemplary embodiment of a cover disk, FIGS. 10, 11 diagrammatically show a section through two further exemplary embodiments of cover disks.

In principle, identical parts are provided with identical designations in the drawings.

WAYS OF IMPLEMENTING THE INVENTION

Figure 1:
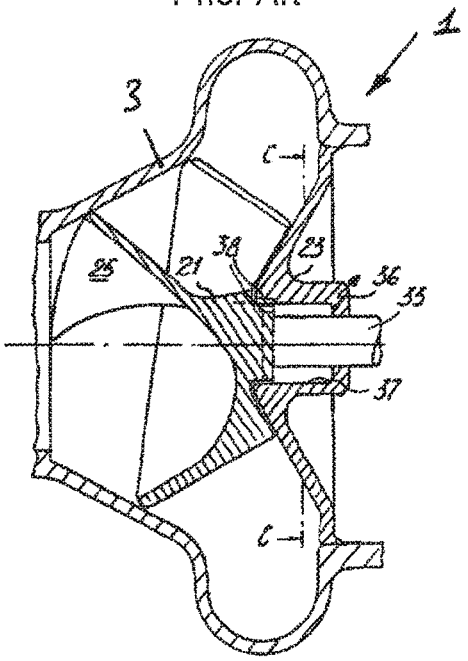
FIG. 1 shows a screw-type centrifugal wheel pump which is known from the prior art.

FIG. 1 shows an embodiment of a screw-type centrifugal wheel pump, which embodiment is known from the prior art and is disclosed in document CH 662 864. FIG. 1 shows an axial section through the screw-type centrifugal wheel pump comprising a screw-type centrifugal wheel with a hub 21 and a blade-type centrifugal wheel 25, comprising a drive shaft 33 which is connected fixedly to the hub 21, and comprising a housing rear wall 23 which is arranged behind the screw-type centrifugal wheel 25, and a housing outer wall 3 which surrounds the screw-type centrifugal wheel 25 in the circumferential direction. An outlet opening 36 is provided in the housing rear wall 23 in the vicinity of the drive shaft 33, in order that gases can escape which are entrained in the conveying medium and are separated against the rotor rotational center and pass into the interior 37 through the gap on the rear side of the rotor between the rotor hub 21 and the housing rear wall 23. The gap between the rotor hub 21 and the housing rear wall 23 is configured as a labyrinth, the labyrinth structure both on the hub side and on the side of the housing rear wall being interrupted by means of a transverse groove 38, in order that a self-cleaning action is produced and no entrained solids pass into the interior 37 and the outlet opening 36.

It has been shown, however, that contaminants can pass into the interior 37 despite this measure, it being possible for said contaminants to be deposited and to accumulate in the interior 37, with the result that cleaning of the screw-type centrifugal wheel pump is required at certain time intervals.

Figure 2:
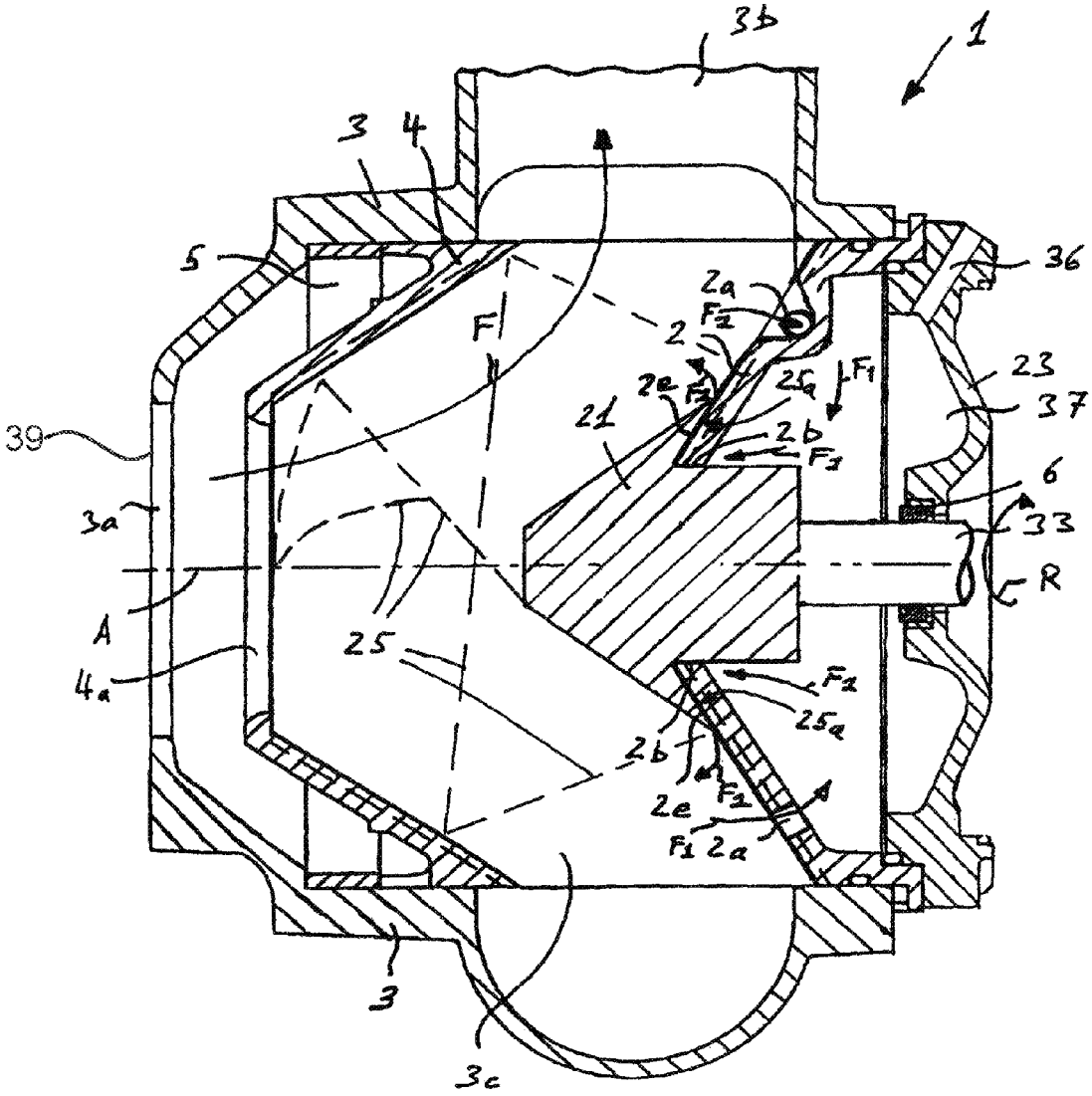
FIG. 2 shows a longitudinal section of a part view of a screw-type centrifugal wheel pump with one exemplary embodiment of a cover disk.

FIG. 2 shows a longitudinal section of one exemplary embodiment of a screw-type centrifugal wheel pump 1 according to the invention. The screw-type centrifugal wheel pump 1 comprises a pump housing 3 with an inlet opening 39 or a pump inflow opening 3*a*, an outlet 3*b* and a housing interior 3*c*, and, furthermore, comprises a hub 21 which is connected to a blade-type centrifugal wheel 25 which is shown only diagrammatically and using dashed lines, and which hub 21 is mounted rotatably via a drive shaft 33 which can be rotated about an axis A. The connection between the drive shaft 33 and the hub is shown only diagrammatically. The blade-type centrifugal wheel 25 and the hub 21 could also be configured as a single, common part, as shown in FIG. 1. In the exemplary embodiment which is shown, the screw-type centrifugal wheel pump 1 additionally comprises a conical inner housing 4 with an inlet opening 4*a* and a spacer ring 5. The screw-type centrifugal wheel pump 1 additionally comprises a housing rear wall 23 with an outlet opening 36 and a seal 6. The outlet opening 36 serves for maintenance purposes and is usually closed from the outside by way of a plug during the operation of the screw-type centrifugal wheel pump 1. During the rotation of the blade-type centrifugal wheel 25, a main flow F is produced which leads to the outlet 3*b* via the inlet opening 3*a*. The conveyed main flow F comprises a fluid, preferably water and possibly gases such as water vapor, the screw-type centrifugal wheel pump 1 being used to convey contaminated water in one preferred use, with the result that the main flow F can also comprise solids, for example feces, sand, grit, textiles, fibers, plastic parts, etc.

The screw-type centrifugal wheel pump 1 additionally comprises a cover plate 2 which is arranged immediately behind the hub 21 or the screw-type centrifugal wheel 25 in the direction of the extent of the axis A. The cover plate 2 has a front side 2*h* and a rear side 2*i*, the front side 2*h* having a substantially frustoconically extending part surface 2*k* in the exemplary embodiment which is shown, the form of which part surface 2*k* is configured so as to be adapted to the rear side of a screw-type centrifugal wheel 25, the part surface 2*k* having a central opening 2*g* in its center, the central opening 2*g* extending parallel in the direction of the axis A. The hub 21 runs through the central opening 2*g*, with the result that a gap 2*b* which runs in the direction of the axis A is formed between the central opening 2*g* and the hub 21. The hub 21 additionally has a protrusion which covers the part surface 2*k* partially, with the result that a gap 2*e* which runs transversely with regard to the axis A is formed between the hub 21 and the part surface 2*k*. The cover plate 2 has at least one aperture 2*a* which is arranged in the region of the part surface 2*k* spaced apart from the central opening 2*g*, the aperture 2*a* forming a fluid-conducting connection between the front side 2*h* and the rear side 2*i* of the cover plate 2. During the pump operation, or during the rotation of the blade-type centrifugal wheel 25 in the rotational direction R, the fluid in the region of the aperture 2*a* has a higher pressure than in the region of the central opening 2*g*, as a result of which a part flow F1 is produced, by part of the main flow F flowing as part flow F1 through the opening 2*a* to the rear side 2*i* of the cover plate 2, and subsequently flowing into the main flow F again via the gap 2*b* and optionally the gap 2*e*. Said part flow F1 causes contaminants which are situated in the interior 37 to be conveyed out of the latter and to be fed to the main flow F.

The hub 21 could also be configured without a protrusion, with the result that no transversely extending gap 2*e* is formed. The hub 21 could also be spaced apart with regard to the part surface 2*k* in such a way that no transversely extending gap 2*e* is formed. The drive shaft 33 could also be moved further forward, with the result that the gap 2*b* is formed at least partially or else exclusively between the cover plate 2 and the drive shaft 33.

The cover plate 2 has a front side 2*h* which is oriented toward the pump inflow opening 3*a*, and the front side 2*h* preferably comprising a part surface 2*k*, the form of which is configured so as to be adapted to the rear side 25*a* of the screw-type centrifugal wheel 25 in such a way that a gap 2*e* of a maximum of up to 3 mm, preferably a gap 2*e* in the range between 0.5 mm and 2 mm, is formed between the front side 2*h* of the cover plate 2 and the rear side 25*a* of the screw-type centrifugal wheel 25.

Figure 3:
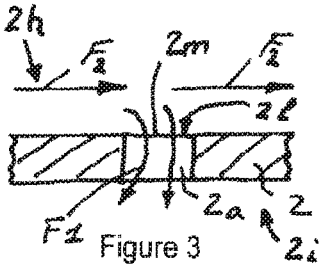
FIGS. 3 to 5 show apertures which run in different ways.

The cover plate 2 has at least one aperture 2*a* and preferably at least two apertures 2*a*. The apertures 2*a* are advantageously arranged symmetrically with regard to the axis A in the part surface 2*k*. The apertures 2*a* can be configured in a multiplicity of possible ways. The aperture 2*a* which is shown in FIG. 2 at the bottom is shown in FIG. 3 on an enlarged scale. A flow F2 flows on the front side 2*h* of the cover plate 2. The opening 2 comprises an inlet opening 2*l*, the cross section of which forms an inlet area 2*m*. The part flow F1 flows through the aperture 2*a* to the rear side 2*i* of the cover plate 2. The part flow F1 is deflected when flowing into the aperture 2*a*, which results in the advantage that solids which are situated in the flow F2 can flow into the aperture 2*a* with greater difficulty. As a result, the part flow F1 is cleaned at least partially of solids, because the solids remain at least partially in the flow F2 and are carried away by the latter.

Figure 4:
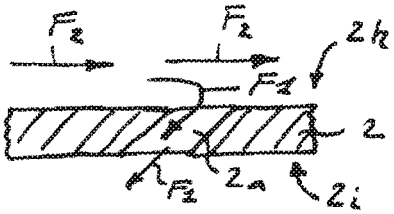

FIG. 4 shows a further exemplary embodiment of an aperture 2*a*. In contrast to the embodiment which is shown in FIG. 3, the aperture 2*a* which is shown in FIG. 4 is arranged so as to run in such a way that the part flow F1 is deflected with regard to the flow F2 which occurs on the front side 2*h* of the cover plate 2, in such a way that said part flow F1 experiences a partial flow reversal. The aperture 2*a* which runs in such a way has the advantage that solids can pass less easily through the aperture 2*a* to the rear side 2*i* of the cover plate 2.

Figure 5:
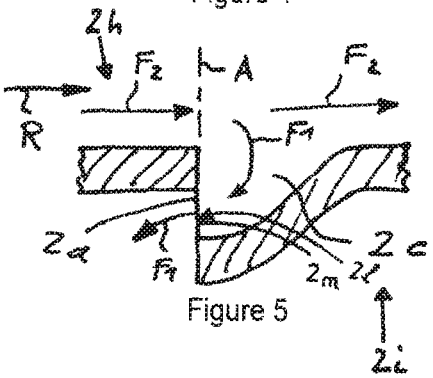

The aperture 2*a* which is shown in FIG. 2 at the top is shown in FIG. 5 on an enlarged scale. A depression 2*c* which opens into the aperture 2*a* is arranged on the front side 2*h* of the cover plate 2, the aperture 2*a* forming an inlet opening 2*l* with an inlet area 2*m*, with the result that the inlet opening 2*l* is arranged in the depression 2*c*. The inlet opening 2*l* or the inlet area 2*m* can be arranged in a wide variety of ways, but advantageously as shown in FIG. 5, in such a way that the part flow F1 is deflected and experiences an at least partial flow reversal with regard to the flow F2 which occurs on the front side 2*h* of the cover plate 2. The inlet opening 2*l* which is arranged in such a way has the advantage that solids can pass less easily through the aperture 2*a* to the rear side 2*i* of the cover plate 2. As shown in FIG. 5, the inlet area 2*m* is arranged in one advantageous embodiment in such a way that it runs parallel or substantially parallel to the axis A. FIG. 5 does not show the axis A per se, but rather the direction of the extent of the axis A. As shown in FIG. 5, the inlet area 2*m* is arranged in a further advantageous embodiment in such a way that it runs perpendicularly or substantially perpendicularly with respect to the rotational direction R of the drive shaft 33, the inlet area 2*m* being arranged so as to face away from the rotational direction R.

Figure 6:
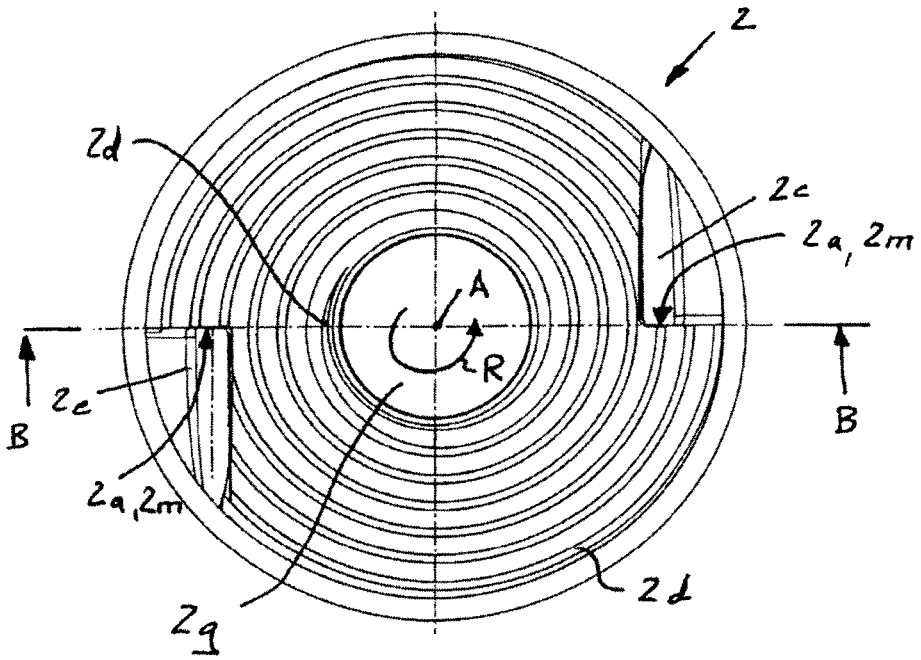
FIG. 6 shows a plan view of a cover disk.
Figure 7:
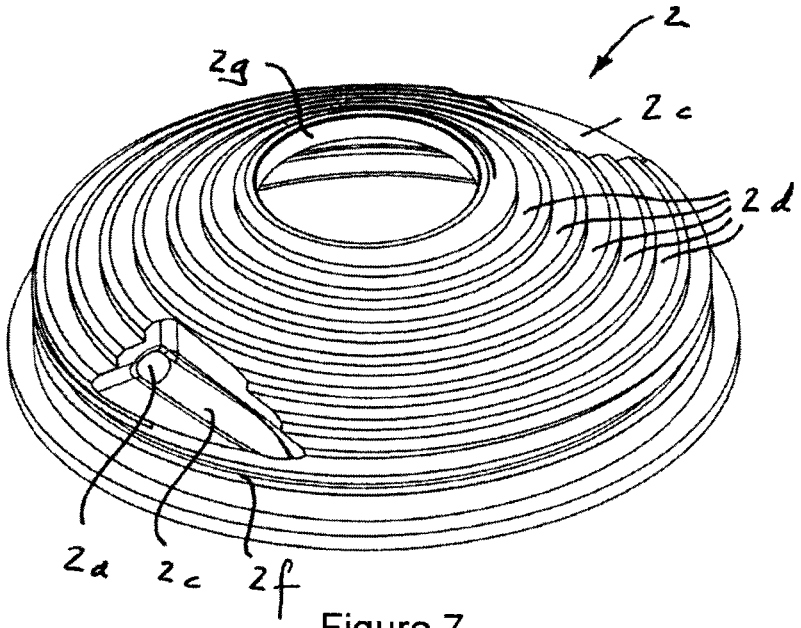
FIG. 7 shows a perspective view of the cover disk which is shown in FIG. 6.

FIGS. 6, 7 and 8 show one exemplary embodiment of a cover plate 2 in a plan view, in a perspective view and in a section along the sectional line B-B. In one advantageous refinement, the depression 2*c*, as shown in FIGS. 6 and 7, can be configured at least partially by a hole which runs substantially perpendicularly or perpendicularly with respect to the axis A. FIG. 6 shows the course of the axis A and the preferred rotational direction R. It can therefore be seen from FIG. 6 that the inlet area 2*m* runs parallel to the axis A and perpendicularly with respect to the rotational direction R. FIG. 8 shows a section of the cover plate 2 with front side 2*h*, rear side 2*i* and central opening 2*g*. The apertures 2*a* are arranged in the frustoconically or substantially frustoconically extending part surface 2*k*, the apertures 2*a* always being arranged spaced apart from the central opening 2*g*. As shown in FIG. 3, the apertures 2*a* could also run perpendicularly or substantially perpendicularly with regard to the part surface 2*k* or, as shown in FIG. 4, could run transversely with regard to the part surface 2*k*.

In one advantageous embodiment, as shown in FIGS. 6 to 8, the cover plate 2 has a depression which runs in the circumferential direction, in particular a spirally extending depression 2*d* which, advantageously beginning in the region of the central opening 2*g*, runs along the part surface 2*h* to the outside. As shown in FIG. 6, the depression 2*d* advantageously extends spirally in the rotational direction R from the inside to the outside. This refinement has the advantage that a contaminant which is conveyed with the aid of the part flow F1 via the central opening 2*g* or the gap 2*b* to the front side 2*h* of the cover plate 2 is conveyed along the depression 2*d* toward the periphery of the part surface 2*k*. The hub 21 which rotates in the rotational direction R above the part surface 2*k* or the screw-type centrifugal wheel 25 which rotates in the rotational direction R additionally helps to move the contaminant which is situated in the depression 2*d* or on the part surface 2*k* in the rotational direction R and to convey it to the outside with regard to the part surface 2*k*, until the contaminant passes to the main flow F and is captured by the latter and carried away. An arrangement of the aperture 2*a* as shown in FIGS. 6 to 8 is therefore particularly advantageous. It can be seen, in particular, from FIG. 6 that the contaminant is moved substantially in the rotational direction R, the aperture 2*a* being arranged in a depression 2*c* and the inlet area 2*m* being oriented such that it faces away from the rotational direction R, with the result that contaminants, even if they flow via the depression 2*c*, scarcely flow, or do not flow at all, through the aperture 2*a* on account of the flow conditions and the movement direction of the contaminants, but rather are fed to the main flow F.

As shown in FIGS. 7 and 8, the cover plate 2 can additionally have a depression 2*f* which runs along the edge region and is provided, in particular, for receiving an O-ring and therefore for sealing purposes.

FIG. 9 shows a section of a further exemplary embodiment of a cover plate 2 which, in contrast to the section which is shown in FIG. 8, has a flatly extending part surface 2*k*, however. Otherwise, the cover plate 2 is of similar configuration to the embodiment which is shown in FIG. 8, by the cover plate 2 according to FIG. 9 also having a depression 2*c* which opens into an opening 2*a*. If the spirally extending depression 2*d* is imagined to be missing, FIG. 6 shows a plan view of the cover plate 2 which is shown in FIG. 9. However, the cover plate 2 which is shown in FIG. 9 could also have a spirally extending depression 2*d*, with the result that a plan view of said embodiment would look the same as shown in FIG. 6. The cover plate 2 which is shown in FIG. 9 additionally has a central opening 2*g* and a front side 2*h* and a rear side 2*i*. The front side 2*h* or the part surface 2*k* can run in a multiplicity of possible ways, for example in a curved manner, as is shown in FIG. 10 diagrammatically in a section, or in a polyhedral manner, as shown in FIG. 11 diagrammatically in a section. In the most preferred embodiment, the part surface extends frustoconically, as shown in FIG. 8.

In one advantageous refinement, the cover plate 2 is configured as a cast piece, the depression 2*c* and advantageously also the aperture 2*a* or the inlet opening 2*l* already forming part of the cast piece which has not yet been machined. In order to finish the cover plate 2, it is then substantially still necessary to machine the front side 2*h*, in particular by way of machining with the removal of material. A cover plate 2 produced from a cast piece which is configured in this way has the advantage that no extra costs or only very low extra costs result during the production, since the machining of the cover plate 2 with the removal of material is necessary in any case. The cover plate 2 which is shown in FIGS. 6 to 8, comprising two depressions 2*c* with apertures 2*a*, can therefore be produced with negligibly small additional costs, in comparison with cover plates 2 without apertures 2*a*.

The method according to the invention makes the self-cleaning action of a screw-type centrifugal wheel pump 1 possible. Here, the screw-type centrifugal wheel pump 1 has a rotatably mounted screw-type centrifugal wheel 25 and a cover plate 2 which is arranged immediately next to or behind the screw-type centrifugal wheel 25 and has a central opening 2*g*, a hub 21 of the screw-type centrifugal wheel 25 or a pin 33 which mounts the screw-type centrifugal wheel 15 extending through the central opening 2*g*, with the result that a fluid-conducting gap 2*b* is formed between the central opening 2*g* and the hub 21 or the pin 33. If the screw-type centrifugal wheel 25 is rotated in the rotational direction R and, as a result, a fluid is conveyed along a main flow F, a part flow F1 of the fluid will flow to the rear side 2*i* of the cover plate 2 via an aperture 2*a* which is spaced apart with regard to the central opening 2*g*, and said part flow F1 will subsequently flow to the main flow F again via the gap 2*b*, on account of the pressure difference which prevails between the aperture 2*a* and the gap 2*b*. Said part flow F1 conveys any contaminants which are situated in the space behind the cover plate 2 to the main flow F again. On the part surface 2*k* of its front side 2*h*, the cover plate 2 advantageously has a spirally extending depression 2*d*, which spirally extends in the rotational direction R from the inside to the outside, with the result that the part flow F1 which exits from the gap 2*b* and the contaminants which are possibly situated in it are fed to the main flow F via the spirally extending depression 2*d*.

In the exemplary embodiments which are shown, the cover plate 2 and the housing rear wall 23 are always shown as separate parts. The cover plate 2 and the housing rear wall 23 could also be configured in a single piece, for example by being produced from a single part, for example a cast part. A single cast part of this type, comprising both the cover plate 2 and the housing rear wall 23, has the advantage that it can be produced inexpensively, and that a seal is no longer required between the cover plate 2 and the housing rear wall 23. This makes a particularly low-maintenance embodiment possible.

Figure 12:
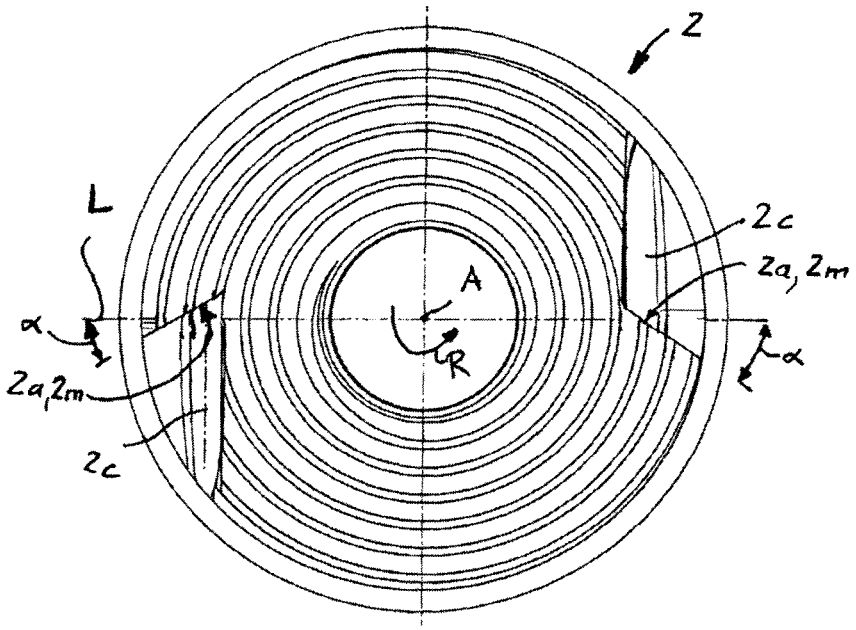
FIG. 12 shows a plan view of a further exemplary embodiment of a cover disk.

FIG. 12 shows a plan view of a further exemplary embodiment of the cover plate 2 which has already been shown in FIG. 6. The opening 2*a* or the inlet area 2*m* once again extends parallel to the axis A, the opening 2*a* or the inlet area 2*m* extending such that it is inclined by an angle α, in contrast to FIG. 6, with regard to a straight line L which extends radially through the axis A, the angle α preferably having a value in the range from ±60 degrees.

The cover plate 2 could also comprise a metal sheet.

The invention claimed is:

1. A cover plate (2) for a screw-type centrifugal wheel pump (1), the cover plate (2) having a front side (2*h*) and a rear side (2*i*), and the front side (2*h*) comprising a part surface (2*k*), the form of which is configured so as to be adapted to the rear side of a screw-type centrifugal wheel (25), the part surface (2*k*) having a central opening (2*g*) in its center, the central opening (2*g*) being configured so as to be adapted for the passage of a rotational axis of the screw-type centrifugal wheel (25) and extending in a direction of the rotational axis (A), and the cover plate (2) having at least one aperture (2*a*) which is arranged in a region of the part surface (2*k*) and spaced apart from the central opening (2*g*), and the aperture (2*a*) forming a fluid-conducting connection between the front side (2*h*) and the rear side (2*i*) of the cover plate (2), and the part surface (2*k*) having a spirally extending first depression (2*d*) which, beginning substantially in a region of the central opening (2*g*), extends along the part surface (2*k*) to an outside, wherein the part surface (2*k*) extends substantially frustoconically, wherein the aperture (2*a*) has an inlet opening (2*l*) toward the front side (2*h*), wherein the front side (2*h*) has a second depression (2*c*), wherein the inlet opening (2*l*) is arranged in said second depression (2*c*), wherein the inlet opening (2*l*) forms an inlet face (2*m*) which extends substantially parallel to the rotational axis (A) and wherein the aperture (2*a*) runs in such a way that a part flow (F1) is deflected with regard to a second flow (F2) which occurs on the front side (2*h*) of the cover plate (2) in such a way that said part flow (F1) experiences a partial flow reversal.

2. The cover plate (2) as claimed in claim 1, characterized in that the rear side (2*i*) extends substantially frustoconically.

3. The cover plate (2) as claimed in claim 1, characterized in that the cover plate (2) has at least two apertures (2*a*), the at least two apertures (2*a*) being arranged, in particular, symmetrically with regard to the rotational axis (A).

4. The cover plate (2) as claimed in claim 1, characterized in that the second depression (2*c*) is formed at least partially by a hole which extends substantially perpendicularly with respect to the rotational axis (A).

5. The cover plate (2) as claimed in claim 1, characterized in that the cover plate (2) consists of a cast piece, and in that the second depression (2*c*) forms part of a non-machined cast piece.

6. The cover plate (2) as claimed in claim 1, characterized in that the aperture (2*a*) extends perpendicularly or substantially perpendicularly with regard to the part surface (2*k*).

7. The cover plate (2) as claimed in claim 1, characterized in that the aperture (2*a*) extends transversely with respect to the part surface (2*h*).

8. A screw-type centrifugal wheel pump (1) comprising a cover plate (2) as claimed in claim 1, further comprising a pump housing (3) with a pump inflow opening (3*a*) and comprising a screw-type centrifugal wheel (25) with a hub (21) and/or a drive shaft (33), the cover plate (2) being arranged directly behind the screw-type centrifugal wheel (25) and on a side (25*a*) of the screw-type centrifugal wheel (25), wherein said side (25*a*) lies opposite the pump inflow opening (3*a*), and a gap (2*b*) being formed between the central opening (2*g*) of the cover plate (2) and the hub (21) and/or the drive shaft (33).

9. The screw-type centrifugal wheel pump (1) as claimed in claim 8, further characterized in that the screw-type centrifugal wheel (25) has a rotational direction (R), characterized in that the aperture (2*a*) has the inlet opening (2*l*) toward the front side (2*h*), in that the front side (2*h*) has the second depression (2*c*), and in that the inlet opening (2*l*) is arranged in said second depression (2*c*) and also having the inlet face (2*m*) which is formed by the inlet opening (2*l*) of the aperture (2*a*) wherein the inlet face (2*m*) extends substantially parallel to the rotational axis (A) and so as to face away from the rotational direction (R).

10. The screw-type centrifugal wheel pump (1) as claimed in claim 9, characterized in that the spirally extending first depression (2*d*) extends from an inside to the outside in the rotational direction (R).

11. The screw-type centrifugal wheel pump (1) as claimed in claim 8, characterized in that the front side (2*h*) is oriented towards the pump inflow opening (3*a*).

12. The screw-type centrifugal wheel pump (1) as claimed in claim 8, wherein the screw-type centrifugal wheel (25) comprises the hub (21), wherein the hub (21) has a protrusion which covers the part surface (2*k*) partially with the result that a gap (2*e*) which runs transversely with regard to the rotational axis (A) is formed between the hub (21) and the part surface (2*k*).

13. A method for self-cleaning of a screw-type centrifugal wheel pump (1) having a rotatably mounted screw-type centrifugal wheel (25) and a cover plate (2) which is arranged immediately next to the screw-type centrifugal wheel (25) and has a central opening (2*g*), a hub (21) or a drive shaft (33) of the screw-type centrifugal wheel (25) extending through the central opening (2*g*), with the result that a fluid-conducting gap (2*b*) is formed between the central opening (2*g*) and the hub (21) or the drive shaft (33), characterized in that the screw-type centrifugal wheel (25) is rotated in a rotational direction (R) and, as a result, a fluid is conveyed along a main flow (F), in that a part flow (F1) of the fluid flows to a rear side (2*i*) of the cover plate (2) via an aperture (2*a*) which is spaced apart with regard to the central opening (2*g*), and in that said part flow (F1) subsequently flows back to the main flow (F) via the gap (2*b*), on account of a pressure difference which prevails between the aperture (2*a*) and the gap (2*b*), in that the cover plate (2) has a front side (2*h*) with a part surface (2*k*) and a spirally extending depression (2*d*) on its front side (2*h*), the spirally extending depression (2*d*) extending from an inside to an outside in the rotational direction (R), with the result that the part flow (F1) which exits from the gap (2*b*) is fed to the main flow (F) via the spirally extending depression (2*d*), wherein the part surface (2*k*) extends substantially frustoconically, wherein the aperture (2*a*) has an inlet opening (2*l*) toward the front side (2*h*), wherein the front side (2*h*) has a second depression (2*c*), wherein the inlet opening (2*l*) is arranged in said second depression (2*c*), wherein the inlet opening (2*l*) forms an inlet face (2*m*) which extends substantially parallel to a rotational axis (A) of a screw-type centrifugal wheel (25), and wherein the aperture (2*a*) runs in such a way that a part flow (F1) is deflected with regard to a second flow (F2) which occurs on the front side (2*h*) of the cover plate (2) in such a way that said part flow (F1) experiences a partial flow reversal.

14. The method as claimed in claim 13, characterized in that the part flow (F1) is deflected when flowing into the aperture (2*a*), in order to separate solids from the part flow (F1) as a result.

15. A cover plate (2) for a screw-type centrifugal wheel pump (1), the cover plate (2) having a front side (2*h*) and a rear side (2*i*), and the front side (2*h*) comprising a part surface (2*k*), the form of which is configured so as to be adapted to the rear side of a screw-type centrifugal wheel (25) which has a rotational direction (R), the part surface (2*k*) having a central opening (2*g*) in its center, the central opening (2*g*) being configured so as to be adapted for the passage of a rotational axis (A) of the screw-type centrifugal wheel (25) and extending in a direction of the rotational axis (A), and the cover plate (2) having at least one aperture (2*a*) which is arranged in a region of the part surface (2*k*) and spaced apart from the central opening (2*g*), and the aperture (2*a*) forming a fluid-conducting connection between the front side (2*h*) and the rear side (2*i*) of the cover plate (2), and the part surface (2*k*) having a spirally extending first depression (2*d*) which, beginning substantially in a region of the central opening (2*g*), extends along the part surface (2*k*) to an outside, wherein the part surface (2*k*) extends substantially frustoconically, wherein the aperture (2*a*) has an inlet opening (2*l*) toward the front side (2*h*), wherein the front side (2*h*) has a second depression (2*c*), wherein the inlet opening (2*l*) is arranged in said second depression (2*c*), wherein the inlet opening (2*l*) forms an inlet face (2*m*) which extends substantially parallel to the rotational axis (A) and so as to face away from the rotational direction (R), wherein the second depression (2*c*) is formed at least partially by a hole which extends substantially perpendicularly with respect to the rotational axis (A), and wherein the aperture (2*a*) runs in such a way that a part flow (F1) is deflected with regard to a second flow (F2) which occurs on the front side (2*h*) of the cover plate (2) in such a way that said part flow (F1) experiences a partial flow reversal.

16. A method for self-cleaning of a screw-type centrifugal wheel pump (1) having a rotatably mounted screw-type centrifugal wheel (25) and a cover plate (2) which is arranged immediately next to the screw-type centrifugal wheel (25) and has a central opening (2*g*), a hub (21) or a drive shaft (33) of the screw-type centrifugal wheel (25) extending through the central opening (2*g*), with the result that a fluid-conducting gap (2*b*) is formed between the central opening (2*g*) and the hub (21) or the drive shaft (33), characterized in that the screw-type centrifugal wheel (25) is rotated in a rotational direction (R) and, as a result, a fluid is conveyed along a main flow (F), in that a part flow (F1) of the fluid flows to a rear side (2*i*) of the cover plate (2) via an aperture (2*a*) which is spaced apart with regard to the central opening (2*g*), and in that said part flow (F1) subsequently flows back to the main flow (F) via the gap (2*b*), on account of a pressure difference which prevails between the aperture (2*a*) and the gap (2*b*), in that the cover plate (2) has a front side (2*h*) with a part surface (2*k*) and a spirally extending depression (2*d*) on its front side (2*h*), the spirally extending depression (2*d*) extending from an inside to an outside in the rotational direction (R), with the result that the part flow (F1) which exits from the gap (2*b*) is fed to the main flow (F) via the spirally extending depression (2*d*), wherein the part surface (2*k*) extends substantially frustoconically, wherein the aperture (2*a*) has an inlet opening (2*l*) toward the front side (2*h*), wherein the front side (2*h*) has a second depression (2*c*), wherein the inlet opening (2*l*) is arranged in said second depression (2*c*), wherein the inlet opening (2*l*) forms an inlet face (2*m*) which extends substantially parallel to a rotational axis (A) of a screw-type centrifugal wheel (25) and so as to face away from the rotational direction (R), and wherein the aperture (2*a*) runs in such a way that a part flow (F1) is deflected with regard to a second flow (F2) which occurs on the front side (2*h*) of the cover plate (2) in such a way that said part flow (F1) experiences a partial flow reversal.

* * * * *